United States Patent [19]

Schönwald

[11] Patent Number: 4,465,436

[45] Date of Patent: Aug. 14, 1984

[54] RADIAL PISTON COMPRESSOR

[75] Inventor: Siegfried Schönwald, Bad Neustadt, Fed. Rep. of Germany

[73] Assignee: Siemens Aktiengesellschaft, Munich, Fed. Rep. of Germany

[21] Appl. No.: 379,553

[22] Filed: May 18, 1982

[30] Foreign Application Priority Data

May 25, 1981 [DE] Fed. Rep. of Germany ..... 3120812

[51] Int. Cl.[3] ..... F04B 35/04; F04B 1/22

[52] U.S. Cl. ..... 417/271; 91/498

[58] Field of Search ..... 415/90; 417/271, 273; 91/491, 498

[56] References Cited

U.S. PATENT DOCUMENTS

| | | | |
|---|---|---|---|
| 1,846,360 | 2/1932 | Rudolph | 417/271 |
| 1,888,860 | 11/1932 | Kercher | 417/271 |
| 1,939,057 | 12/1933 | Kercher | 417/277 |
| 2,515,033 | 7/1950 | Conner | 91/498 |
| 3,037,457 | 6/1962 | Steinlicht | 415/90 |
| 3,810,418 | 5/1974 | Bosch | 91/498 |
| 4,328,739 | 5/1982 | Rutz | 91/498 |

FOREIGN PATENT DOCUMENTS

| | | | |
|---|---|---|---|
| 1566687 | 5/1980 | United Kingdom | 417/271 |

*Primary Examiner*—William L. Freeh
*Attorney, Agent, or Firm*—Kenyon & Kenyon

[57] ABSTRACT

Improvements are disclosed in a radial piston compressor having pistons reciprocally disposed in the piston spaces of a cylinder block rotatably supported on a stationary shaft. The radial motion of the pistons is controlled by a rotatable guide which is arranged with its axis of rotation eccentrically to the axis of rotation of the cylinder block. The portion of the stationary shaft covered by the cylinder block includes a suction slot and a pressure slot extending along a portion of the circumference of the stationary shaft. Oil for sealing the cylinder block and the stationary shaft is introduced into the gap between the cylinder block and the stationary shaft. Due to the rotation of the cylinder block, the piston spaces are communicated alternatingly with the suction slot and the pressure slot through an opening provided in the bottom of the piston spaces. In order to obtain good sealing of the gap between the cylinder block and the stationary shaft by the oil contained in this gap, the gap is provided with a cross section which decreases from the suction slot toward the pressure slot, the oil being introduced into the gap in the vicinity of the largest gap cross section.

16 Claims, 5 Drawing Figures

RADIAL PISTON COMPRESSOR

BACKGROUND OF THE INVENTION

The present invention relates to a radial piston compressor of the type having pistons radially reciprocable in piston cylinders of a cylinder block which is rotatably supported on a stationary shaft.

A radial piston compressor of the above type is disclosed in British Patent Specification No. 1,566,687. In the radial piston compressor disclosed in this British patent specification, oil is sucked into the cylinder block along with the medium to be compressed and seals and lubricates the pistons. The oil sucked into the cylinder block also penetrates between the cylinder block and the surface of the valve body associated with the stationary shaft and seals gaps between the cylinder block and the valve body and also lubricates the cylinder block and the valve body surfaces sliding on one another. The seal between the cylinder block and the valve body associated with the stationary shaft is not entirely satisfactory because oil which penetrates between the cylinder block and the valve body is displaced by the compressed gas and blown out of the gaps between the cylinder block and the stationary shaft.

OBJECT AND SUMMARY OF THE INVENTION

It is an object of the present invention to provide an improved seal between the cylinder block and the stationary shaft of a radial piston compressor of the type described above.

The above and other objects are achieved according to the invention by providing a gap between the cylinder block and the stationary shaft having a cross-section which decreases in the direction from the suction slot toward the pressure slot with the oil being introduced into the gap in the vicinity of its largest cross section.

In the radial piston compressor according to the invention, the radial motion of the pistons is controlled by a rotatable guide which is arranged with its axis of rotation eccentric to the axis of rotation of the cylinder block. A suction slot and a pressure slot are provided on the stationary shaft in a region thereof covered by the cylinder block and extend over part of the circumference of the stationary shaft. Oil is introduced into the gap between the cylinder block and the stationary shaft, as indicated above. The individual piston spaces have in their end or bottom adjacent to the stationary shaft an opening which lies in the same plane as the suction and pressure slots, at least on the bottom side facing the shaft. Due to its viscosity, the oil is taken along with the rotating cylinder block. Decreasing the gap cross section from the suction slot to the pressure slot according to the invention at least at one point leads to an increase in the pressure acting on the oil which by the configuration of the gap cross section can be made equal to or larger than the pressure increase of the gas being compressed. Since the oil between the cylinder block and the stationary shaft is under high pressure, it cannot be blown out of the gap by the gas being compressed.

In an embodiment of a radial piston compressor having a cylinder block supported on the stationary shaft by an antifriction bearing, a gap which decreases in cross section toward the pressure slot can be provided in accordance with one aspect of the invention by providing a slot on each side of the suction slot in the area of the stationary shaft covered by the cylinder block. Each such slot is axially spaced from the suction slot and extends in the circumferential direction approximately from the start of the suction slot at least to approximately the end of the pressure slot. The depth and/or width, i.e. the cross section, of each such slot decreases from the suction slot toward the pressure slot. According to an aspect of the invention, the depth and/or width of each such slot can be reduced stepwise to facilitate production.

According to an aspect of the invention, a slot of decreasing cross section can also be provided in a radial piston compressor having a cylinder block supported on the stationary shaft by an antifriction bearing, by arranging the antifriction bearing eccentrically with respect to the stationary shaft.

For a compressor in which the cylinder block is supported by an antifriction bearing, the cross-sectional reduction of the gap can be determined by mechanical configuration. For a compressor which operates with different gas pressures, the cross sectional reduction of the gap is such that the hydrodynamically generated oil pressure corresponds approximately to the highest output gas pressure generated.

For a compressor which operates at lower output gas pressures, it is possible for the oil in the gap to move against the flow of the gas being compressed due to the higher pressure of the oil, and thereby flow out of the gap toward the piston spaces. Oil penetrating into the piston spaces is ejected together with the gas being compressed at the end of the compression stroke, which can lead to oil shocks. To prevent oil from penetrating into the piston spaces, automatic matching of the oil pressure in the gap to the output gas pressure is provided in accordance with another aspect of the invention.

Such automatic pressure matching is achieved according to the invention by rotatably supporting the cylinder block directly on the surface of the stationary shaft covered by the cylinder block with the shaft surface being provided as a bearing surface. The radial load of the cylinder block, averaged over the circumference as the reaction force of the piston forces, is approximately proportional to the output pressure of the gas. Under this radial load, the cylinder block adjusts its position relative to the stationary shaft in such a manner that the oil pressure hydrodynamically building up in the gap between the cylinder block and the stationary shaft is in equilibrium with the gas pressure under this radial load. As the output gas pressure increases, the radial force increases as does the degree of eccentricity between the cylinder block and the stationary shaft, thereby also increasing the oil pressure. A suitable width of the sealing gap can provide a hydrodynamic oil pressure in the order of magnitude of the corresponding output gas pressure of the respective piston over a wide range of output gas pressures.

Such matching of the oil and gas pressures can be obtained in accordance with the invention by making the effective supporting area $B \times D$ of the cylinder block equal to 0.8 to 1.3 $A/\sin \pi/Z$, where B is the effective total width of the gap between the cylinder block and the stationary shaft, D is the diameter of the gap, A is the cross sectional area of a piston, and Z corresponds to the number of pistons disposed in one radial plane and is at least equal to 2.

In accordance with an aspect of the invention, it has been found to be practical to provide on both sides of the suction slot at least one channel having a cross section which is larger than the largest possible cross section of the gap between the cylinder block and the stationary shaft. Oil is introduced into the vicinity of the forward end of the channel relative to the direction of rotation. Through such a channel, the oil pressure is raised somewhat above the suction pressure present at the end of the suction slot. The oil pressure then increases toward the pressure slot in proportion to the output gas pressure. An increase in oil pressure within the channel is achieved by providing the channel with a cross section decreasing toward the end of the suction slot.

The sealing effect of the oil films, between the stationary shaft and the rotating cylinder block as well as between the pistons and the walls of the piston spaces, can be improved further by disposing the cylinder block and the stationary shaft in a closed, pressure housing in which the pressure is maintained between the suction pressure and the output gas pressure of the compressor. In such a closed housing, a pressure equilibrium results from adjustment of respective pressures under the action of gap losses flowing out on the output side and in on the suction side. In order to minimize the gap and ventilation losses, a predetermined pressure is maintained in the housing which can be adjusted by providing at the stationary shaft a passage opening into the housing in the circumferential region of the shaft between the suction slot and the pressure slot. The passage is arranged at that point in the circumferential region at which the pressure in the piston spaces is equal to the predetermined pressure.

In an embodiment in which the cylinder block of the radial piston compressor is coupled to the rotor of an external rotor drive motor, collection and subsequent cleaning of the excess oil emerging from the gaps of the cylinder block can be accomplished in accordance with an aspect of the invention by providing a bell at least partially covering the cylinder block. The bell is connected to the external rotor and has a wall somewhat inclined outwardly toward the open end of the bell. Due to the inclination, the oil can flow toward and off the end of the bell under the action of the centrifugal force. Because the specific weight of the oil is smaller than that of the impurities, the heavier impurities adhere to the wall of the bell. The cleaning effect can further be improved by providing means on the inside wall of the bell for retaining impurities. For example, the inside wall can be made rough or it can be provided with a rough coating, or one or more circular grooves can be provided at the inside wall of the bell such that the impurities accumulate in the grooves.

The bell is advantageously fastened to the lamination stack of the external rotor. As a result, cost is reduced because the bell can be made integrally with the shorting ring of the external rotor. Since such a bell has a smooth surface, only small friction losses occur so that ventilation losses are additionally reduced by such a bell.

The above and other objects, features, aspects and advantages of the invention will be more apparent from the following description of the preferred embodiments of the invention taken in conjunction with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENTS

Figure 1:
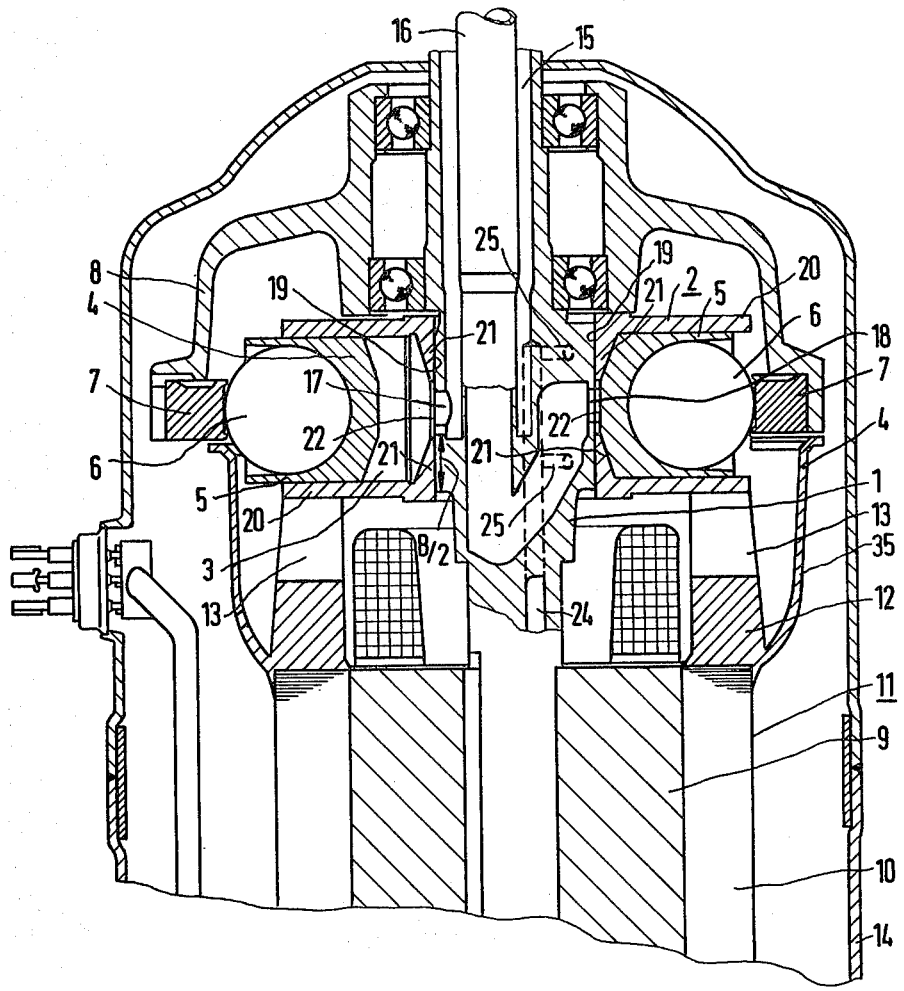
FIG. 1 is an axial cross-sectional view of a portion of a radial piston compressor according to the invention.

Referring more particularly to the drawings, a radial piston compressor of the type having an external rotor drive motor is illustrated. As shown in FIG. 1, the radial piston compressor includes a cylinder block 2 which is rotatably disposed on a stationary shaft 1. A plurality of cylindrical piston spaces 3 are provided in the cylinder block 2 distributed uniformly over the circumference of the block. A piston 4 is movably disposed in each piston space 3. The pistons 4 comprise a cup-shaped support 5 into which a sphere 6 is disposed. The spheres roll on a guide ring 7 supported by a guide 8 itself supported on the stationary shaft 1 eccentrically relative to the cylinder block 2. As a result of the eccentric arrangement of the cylinder block 2 and the guide 8, the pistons 4 are reciprocated in the piston spaces 3. In the compressor configuration shown in FIG. 1, the left-hand piston 4 is in its lower dead center position (UT), and the right-hand piston 4 is in its upper dead center position (OT).

An external-rotor motor having an internal stator 9 secured to the stationary shaft 1 is provided as a drive motor 11. The external rotor 10 of the motor is coupled to the cylinder block 2 by arms 13 which are connected at their end faces to respective shorting rings 12 of the rotor. The compressor unit formed by the radial piston compressor and the drive motor 11 is mounted in a pressure-proof housing 14.

The stationary shaft 1 is hollow at its end adjacent the compressor where a suction duct 15 is formed for the gas to be compressed. A pressure inlet duct 16 is arranged concentrically in the hollow part of the stationary shaft 1 and is in communication with the pressure slot 18 of the radial piston compressor. The suction duct 15 is in communication with the suction slot 17 of the radial piston compressor.

The area of the stationary shaft 1 covered by the cylinder block 2 is provided as a bearing surface 19. The cylinder block 2 is supported by a ring 21 which also forms the end or bottom of the individual cylinder spaces 3 and at which the individual cylinders 20 are disposed. In the bottom of each piston space 3, an opening 22 is provided which coincides with the suction and pressure slots 17 and 18, respectively.

A bore 24 is provided in the stationary shaft 1 extending to the lower end of the shaft. Two holes 25 extend transversely into the shaft in communication with the bore 24. The transverse holes 25 extend up to the bearing surface 19 and are covered by the ring 21. Oil is pumped through bore 24 and the transverse holes 25 to the area between the bearing surface 19 and the ring 21 of the cylinder block 2.

Figure 2:
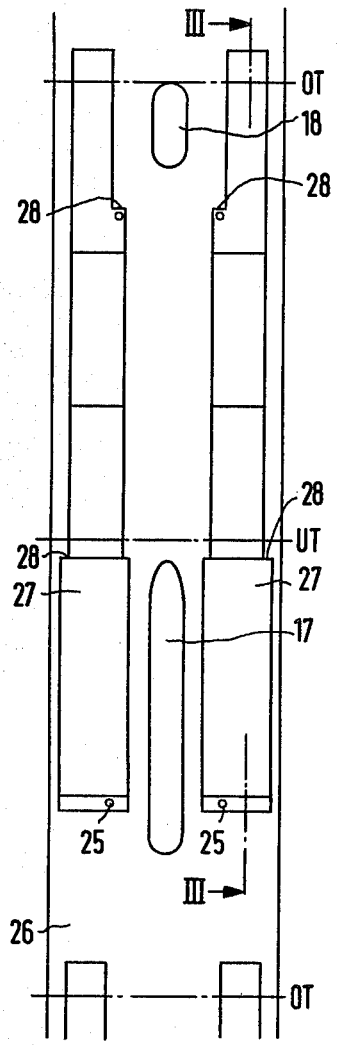
FIG. 2 is a detail view of a portion of the stationary shaft of the compressor of FIG. 1 which is covered by the cylinder block and depicts the compressor suction and pressure slots.
Figure 3:
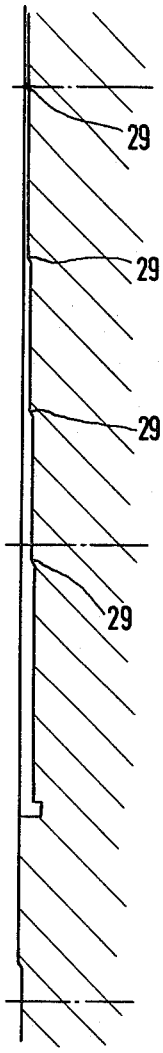
FIG. 3 is a cross-sectional view of the area of the compressor shown in FIG. 2 taken along line III—III therein.

Referring to FIG. 2 which depicts the portion designated 26 of the stationary shaft 1 covered by the cylinder block 2, the suction slot 17 extends almost up to the lower dead center position (UT) of the piston. Compression of gas takes place during movement of the piston from the suction slot 17 to the pressure slot 18. A slot 27 is disposed on each side of the suction slot 17 extending beyond the pressure slot 18. In the area between the suction slot 17 and the pressure slot 18, each slot 27 is reduced in width by a plurality of steps 28 and is also reduced in depth as shown in FIG. 3 by a plurality of steps 29. Oil introduced into the slot 27 through the transverse holes 25 is moved along the length of the slot by the rotating cylinder block 2. As a result of the reduction in cross-section of slot 27 by steps 28 and 29, oil moving along slot 27 is subjected to higher and higher pressures corresponding to the output pressure building up between the suction slot 17 and the pressure slot 18. Depending on the configuration of the slot 27, the pressure of the oil can even exceed the output gas pressure. Arranging the slots 27 on both sides of the suction slot 17 and the pressure slot 18 is particularly advantageous in a radial piston compressor in which the cylinder block 2 is supported on the stationary shaft 1 by means of an antifriction bearing.

Figure 4:
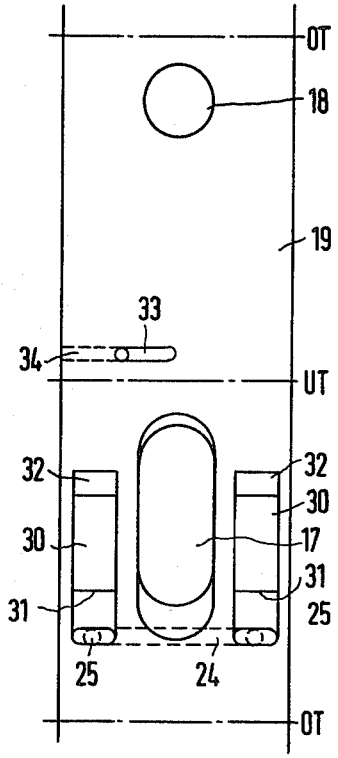
FIG. 4 is a detail view of a portion of a stationary shaft of a compressor which is covered by a cylinder block according to another embodiment of the invention.
Figure 5:
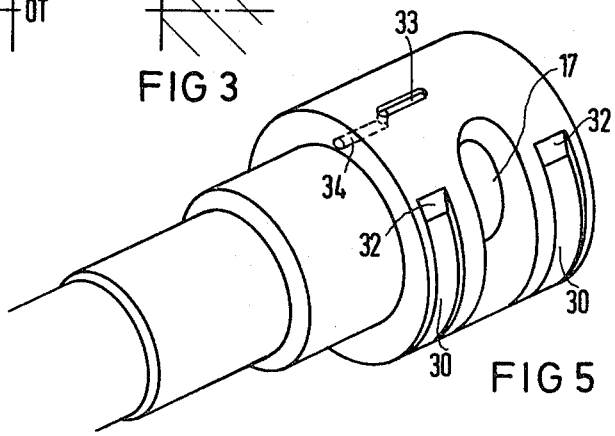
FIG. 5 is a perspective view of the area between the cylinder block and the stationary shaft depicted in FIG. 4.

Referring to the embodiment of FIGS. 4 and 5, in the stationary shaft 1 a channel 30 is formed in the bearing surface 19 of the stationary shaft 1 on each side of the suction slot 17. The transverse holes 25 which are in communication with the bore 24 open into the two channels 30. The channels 30 are, for example, stepped in depth at 31 and merge with the bearing surface 19 in an inclination 32 at the end of the channel. The reduction in cross-section of the channel 30 due to the depth reduction 31 and/or the inclination 32 causes the pressure of the oil introduced into the channel 30 through the transverse hole 25 to increase, similar to the increase in oil pressure in slots 27. The channels 30 extend approximately to the end of the suction slot 17. An increase of the oil pressure at the ends of channels 30 can also be achieved if the cross section of the gap between the cylinder block 2 and the stationary shaft 1 adjacent to the channels 30 is smaller than the cross section of the channel, rather than reducing the cross section of channels 30. Since the cylinder block 2 is rotatably supported relative the bearing surface 19, a gap forms between the ring 21 of the cylinder block 2 and the bearing surface 19 due to the pressure prevailing in the piston spaces. The width of the gap decreases from the suction slot 17 toward the pressure slot 18. In the reduced cross-section channels 30, the oil pressure is raised somewhat above the suction pressure of the gas toward the end of the suction slot 17. Due to the reduction of the width of the gap between the cylinder block and the stationary shaft in the area of the pressure slot 18, the oil pressure, like the gas pressure, is raised continuously in the piston spaces 3.

In the circumferential region between the suction slot 17 and the pressure slot 18, a transverse slot 33 (FIGS. 4 and 5) is formed in the bearing surface 19 which extends at least to below the opening 22 in the bottom of the piston spaces 3. A connection between the transverse slot 33 and the exterior of the compressor is established via an axial hole 34. In the compressor unit of FIG. 1 in which the rotary piston compressor and its drive motor are disposed in a pressure housing 14, pressure equalization within the pressure housing 14 is established via the transverse slot 33 and the axial hole 34. Thus, the pressure in the interior of the housing 14 approximately corresponds to the pressure that prevails at the point of the transverse slot 33.

In the embodiments of a radial piston compressor shown in FIGS. 1-5, a satisfactory seal between the cylinder block 2 and the bearing surface 19 is achieved by a rise in oil pressure, corresponding to the increasing gas pressure between the suction slot 17 and the pressure slot 18, in the gap existing between the cylinder block 2 and the bearing surface 19. Depending on the particular bearing support utilized for the cylinder block 2, the rise in oil pressure can be achieved in different ways.

For example, for a cylinder block 2 supported on the stationary shaft by means of an antifriction bearing, slots 27 having a cross section which decreases toward the pressure slot 18 are provided on both sides of the suction slot 17. Because of this reduction in cross section, an increase in oil pressure of the oil carried along by the cylinder block 2 is obtained. The antifriction bearing and the configuration of the slots 27 determine the dimensions of the gap between the cylinder block 2 and the area 26 of the stationary shaft 1 covered by the block, as well as the reduction in cross-section of the slots 27. Accordingly, a predetermined oil pressure can be generated independently of the prevailing pressure of the gas discharged by the unit. An appropriate configuration of the cross section of the slots 27 can provide an oil pressure which exceeds that of the discharged gas. However, if the compressor operates at lower pressures, there exists the danger that oil will penetrate into the piston spaces 3.

Automatic adaptation of the oil pressure to the respective output gas pressure can be obtained by supporting cylinder block 2 directly on the stationary shaft 1 in accordance with the embodiment depicted in FIGS. 4-5. The support surface 19 at the stationary shaft 1 forms a sliding bearing with the ring 21 of the cylinder block 2 resting directly on the support surface 19. The output pressure acting unilaterally in the cylinder block 2 leads to an eccentric adjustment of the cylinder block 2 relative to the bearing surface 19 at the stationary shaft 1. The cylinder block 2 is urged against the bearing surface 19 with the greatest force, thus providing the smallest gap width, where the output gas pressure is the highest. As a consequence of this reduced gap width, oil pressure is increased. Appropriately configuring the bearing surface of the cylinder block 2 which rests on the bearing surface 19 can cause an oil pressure to be generated in the gap corresponding to the output gas pressure. The effective width of the gap area corresponds to the portion of the ring 21 resting on the bearing surface 19.

In the pressure housing 14 enclosing the compressor unit, a pressure is generated having a magnitude between the suction pressure and the output pressure. Since gases are often compressed in radial piston compressors which have a higher specific gravity than air, ventilation losses rise steeply with the increased pressure in the pressure-proof housing 14. To reduce these ventilation losses, a bell 35 which at least partially covers the cylinder block 2 is fastened to the external rotor 10 of the drive motor 11. The gas in the interior of the bell 35 rotates with the piston. Thus, the difference in relative velocities of the rotating gas and rotating cylinder block 2 are small so that the ventilation losses are also small. On the other hand, only small ventilation losses occur at the smooth outside of the bell 35 vis-a-vis the gas in the pressure-proof housing 14. Arranging the transverse slot 33 between the suction slot 17 and the pressure slot 18 enables the pressure in the pressure-proof housing 14 to be set so that the gap and ventilation losses are minimized.

The bell 35 can be produced in one operation together with the shorting ring 12 and the arms 13. Slightly inclining the wall of the bell 35 outward toward the open end of the bell advantageously causes separation of impurities present in the oil. The oil emerging from the gap between the cylinder block 2 and the bearing surface 19 drops or is ejected into the bell 35. The centrigual force caused by the rotation of the bell permits the oil to run off the outwardly inclined wall of the bell 35 toward its open end. The impurities which are heavier than the oil on the other hand adhere to the wall of the bell. The cleaning effect can be improved by appropriate means provided at the wall of the bell, for example, by roughening the surface of the wall or by applying a rough coating or one or more circular grooves to the wall of the bell.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purpose of disclosure without departing from the spirit and scope of the invention.

What is claimed is:

1. In a radial piston compressor comprising a cylinder block rotatably supported on a stationary shaft, pistons reciprocally disposed in spaces of the cylinder block, a guide rotatably disposed about the cylinder block with its axis of rotation eccentric to that of the cylinder block, there being a gap between the stationary shaft and the interior of the cylinder block, a suction slot and a pressure slot extending circumferentially over a portion of the stationary shaft covered by the cylinder block, and means for introducing oil into said gap, the improvement comprising a configuration in which the cross-section of the gap decreases in the direction from the suction slot to the pressure slot with the oil being introduced into the gap in the vicinity of the largest gap cross-section such that the pressure of the oil introduced into the gap is equal to or greater than the pressure of the gas being compressed, whereby an improved seal between the stationary shaft and the cylinder block is obtained.

2. In the radial piston compressor and the improvement therein according to claim 1, in which the cylinder block is supported on the stationary shaft by means of an antifriction bearing, the improvement comprising disposition of the antifriction bearing eccentrically relative to the stationary shaft.

3. In the radial piston compressor and the improvement therein according to claim 1, in which the cylinder block is supported on the stationary shaft by means of an antifriction bearing, the improvement comprising at least one further slot disposed on each side of the suction slot in a portion of stationary shaft covered by the cylinder block circumferentially extending from approximately the start of the suction slot to at least approximately the end of the pressure slot, each further slot being reduced in at least a portion of at least one of its depth and its width as the respective slot extends from the suction slot toward the pressure slot.

4. In the radial piston compressor and the improvement therein according to claim 3, the improvement comprising at least one of the depth and width of each further slot being reduced stepwise.

5. In the radial piston compressor and the improvement therein according to claim 1, the improvement comprising a bearing surface disposed on the stationary shaft in the area covered by the cylinder block on which the cylinder block is rotatably and directly supported.

6. In the radial piston compressor and the improvement therein according to claim 5, the improvement comprising the effective supporting area $B \times D$ of the cylinder block being equal to 0.8 to $1.3 \times A/\sin(\pi/Z)$, where B is the effective total width of the gap between the cylinder block and the stationary shft, D is equal to the diameter of the gap, A is the cross-sectional area of a piston, and Z corresponds to the number of pistons disposed in a radial plane and is at least equal to 2.

7. In the radial piston compressor and the improvement therein according to claim 5 or 6, the improvement comprising at least one channel provided on each side of the suction slot having a cross section larger than the largest cross section of the gap between the cylinder block and the stationary shaft, oil being introduced into the channel in the vicinity of its beginning relative to the direction of rotation.

8. In the radial piston compressor and the improvement therein according to claim 7, the improvement comprising each channel having a cross section which decreases in the direction of the suction slot relative to the direction of rotation.

9. In the radial piston compressor and the improvement therein according to claim 1, the improvement comprising the cylinder block and the stationary shaft being disposed in a closed, pressure housing, and means for maintaining the pressure in the housing between the suction pressure and the output pressure of the compressor.

10. In the radial piston compressor and the improvement therein according to claim 9, the improvement comprising a passage provided in the circumference of the stationary shaft opening into the housing between the suction slot and the pressure slot.

11. In the radial piston compressor and the improvement therein according to claim 9, in which the cylinder block is coupled to the rotor of an external rotor drive motor, the improvement comprising a bell connected to the external rotor at least partially covering the cylinder block and having a wall inclined outwardly toward the open end of the bell.

12. In the radial piston compressor and the improvement therein according to claim 11, the improvement comprising means associated with the inside wall of the bell for retaining impurities in oil passing over the inside wall.

13. In the radial piston compressor and the improvement therein according to claim 12, the improvement comprising said means being a roughened surface on said inside wall.

14. In the radial piston compressor and the improvement therein according to claim 12, the improvement comprising said means being one or more circular grooves provided in said inside wall.

15. In the radial piston compressor and the improvement therein according to claim 11, 12, 13 or 14, wherein the external rotor includes a lamination stack, the improvement comprising the bell being fastened to the lamination stack of the external rotor.

16. In the radial piston compressor and the improvement therein according to claim 15, wherein the external rotor includes a shorting ring, the improvement comprising the bell being integral with the shorting ring of the external rotor.

* * * * *